US011085103B2

(12) United States Patent
Hardy et al.

(10) Patent No.: US 11,085,103 B2
(45) Date of Patent: Aug. 10, 2021

(54) NICKEL-BASE SUPERALLOY

(71) Applicant: ROLLS-ROYCE PLC, London (GB)

(72) Inventors: Mark C Hardy, Derby (GB); Katerina Christofidou, Cambridge (GB); Paul M Mignanelli, Didcot (GB); Howard J Stone, Cambridge (GB); Nicholas G Jones, Cambridge (GB); Christos Argyrakis, Derby (GB)

(73) Assignee: ROLLS-ROYCE PLC, London (GB)

( * ) Notice: Subject to any disclaimer, the term of this patent is extended or adjusted under 35 U.S.C. 154(b) by 136 days.

(21) Appl. No.: 16/417,694

(22) Filed: May 21, 2019

(65) Prior Publication Data

US 2019/0360078 A1 Nov. 28, 2019

(30) Foreign Application Priority Data

May 23, 2018 (GR) ..... 20180100224
May 23, 2018 (GR) ..... 20180100225

(51) Int. Cl.
*C22C 19/05* (2006.01)
*C22F 1/10* (2006.01)
*C22C 1/04* (2006.01)

(52) U.S. Cl.
CPC ..... *C22C 19/056* (2013.01); *C22C 1/0433* (2013.01); *C22F 1/10* (2013.01)

(58) Field of Classification Search
CPC ... B22F 2301/15; C22C 1/023; C22C 1/0433; C22C 19/03; C22C 19/05; C22C 19/051; C22C 19/056; C22C 19/057; C22C 19/058; C22F 1/10
See application file for complete search history.

(56) References Cited

U.S. PATENT DOCUMENTS 5,129,968 A * 7/1992 Henry ..... C22C 19/056 148/428
5,403,547 A 4/1995 Smith et al.
5,476,555 A * 12/1995 Erickson ..... C22C 19/056 148/410
5,882,586 A 3/1999 Tamura et al.
6,054,096 A * 4/2000 Duhl ..... C22C 19/057 420/442
2015/0192022 A1* 7/2015 Reed ..... F01D 5/28 416/241 R
2015/0354031 A1 12/2015 Gehrmann et al.
2017/0022586 A1 1/2017 Hardy et al.
2017/0240996 A1 8/2017 Osaki et al.
2018/0002794 A1* 1/2018 Detor ..... C22C 19/056

FOREIGN PATENT DOCUMENTS

| | | | |
|---|---|---|---|
| EP | 0184136 | A2 | 6/1986 |
| EP | 0371208 | A1 | 6/1990 |
| EP | 0709477 | A1 | 5/1996 |
| EP | 1 801 251 | A1 | 6/2007 |
| EP | 2602336 | A1 | 6/2013 |
| EP | 2805784 | A1 | 11/2014 |
| EP | 2894234 | A1 | 7/2015 |
| EP | 3112485 | A1 | 1/2017 |
| GB | 1395125 | A | 5/1975 |
| JP | S60-116740 | A | 6/1985 |
| JP | H11-217644 | A | 8/1999 |
| JP | 2009-132964 | A | 6/2009 |

OTHER PUBLICATIONS

Sep. 16, 2019 Extended Search Report issued in European Patent Application No. 19175122.1.
Dec. 14, 2018 Search Report issued in British Patent Application No. 1811654.1.
Dec. 14, 2018 Search Report issued in British Patent Application No. 1811653.3.
U.S. Appl. No. 16/417,689 filed May 21, 2019 in the name of Mark C Hardy et al.
Sep. 12, 2019 Extended Search Report issued in European Patent Application No. 19175121.3.
Mar. 16, 2021 Office Action issued in U.S. Appl. No. 16/417,689.
D.U. Furrer and S.L. Semiatin, "Forging of Nickel-Base Alloys," ASM Handbook, vol. 14A, 2005, pp. 324-330. (Year: 2005).

* cited by examiner

*Primary Examiner* — Vanessa T. Luk
(74) *Attorney, Agent, or Firm* — Oliff PLC

(57) ABSTRACT

A nickel-base superalloy includes essentially, by weight: 14.75 to 26.5 percent cobalt, 4.1 to 4.65 percent aluminium, 1.1 to 1.9 percent titanium, 3.85 to 6.3 percent tantalum, 1.2 to 2.55 percent niobium, up to 0.07 percent boron, up to 0.06 percent carbon, up to 14.0 percent chromium, up to 1.0 percent iron, up to 1.0 percent manganese, up to 4.2 percent molybdenum, up to 0.5 percent silicon, up to 4.9 percent tungsten, and up to 0.1 percent zirconium, the balance being nickel and incidental impurities; wherein the overall concentration in the alloy of aluminium, titanium, tantalum, and niobium is from 13 to 14 atomic percent and the atomic ratio of aluminium to titanium is from 4.625:1 to 6.333:1.

16 Claims, No Drawings

NICKEL-BASE SUPERALLOY

TECHNICAL FIELD

This disclosure concerns nickel-base superalloys.

BACKGROUND

Nickel-base superalloys are typically used in high-temperature applications, such as in the high pressure compressor and turbine sections of gas turbine engines. Improvements in such alloys, particularly those used for disc rotors, may allow gas turbine engines to operate with higher compressor exit and turbine entry temperatures, thereby reducing fuel burn as a leaner mixture is facilitated.

Such operating conditions, however, give rise to fatigue cycles with long dwell periods at elevated temperatures, in which oxidation and time-dependent deformation significantly influence the alloy's resistance to low cycle fatigue. As a result, it is desirable to improve the resistance of alloys to dwell fatigue or time-dependent crack growth and surface environmental damage, but without any associated formation of detrimental phases during high temperature exposure, reduction in yield stress, reduction in resistance to creep strain accumulation, and increases in density, etc.

Current alloys are only able to address some of these issues, particularly for operating temperatures of 750 degrees Celsius and above. In particular, chromium levels are reduced to allow high levels of matrix and precipitation strengthening without an associated formation of detrimental phases during prolonged exposure to high temperature. This, however, has the consequence of reducing the alloy's resistance to hot corrosion and oxidation damage, for example.

Further, current alloys rely on an increased quantity of small (10 to 30 nanometre) gamma prime precipitates to provide resistance to creep strain accumulation from high stresses at temperatures below 750 degrees Celsius. However, high levels of gamma prime result in high rates of time-dependent crack growth, and also result in a reduced heat treatment window, i.e. the difference between the solution heat treatment temperature, and the temperature at which incipient melting begins.

The latter arises as a uniform coarse grain microstructure is necessary to optimise resistance to time-dependent crack growth, and is produced from solution heat treatment above the gamma prime solvus temperature, i.e. the temperature at which grain boundary primary gamma prime particles dissolve. Unfortunately, the solution heat treatment temperature is then very close to the incipient melting temperature of the alloy. This results in alloy forgings that are difficult to process and thus may not achieve required strength levels, or alternatively an alloy that is not optimised in terms of grain boundary strength or ductility.

SUMMARY

The invention is directed towards nickel-base superalloys, and methods of producing nickel-base superalloys.

One such nickel-base superalloy consists essentially of:

14.75 to 26.5 percent cobalt;
4.1 to 4.65 percent aluminium;
1.1 to 1.9 percent titanium;
3.85 to 6.3 percent tantalum;
1.2 to 2.55 percent niobium;
up to 0.07 percent boron;
up to 0.06 percent carbon;

up to 14.0 percent chromium;
up to 1.0 percent iron;
up to 1.0 percent manganese;
up to 4.2 percent molybdenum;
up to 0.5 percent silicon;
up to 4.9 percent tungsten;
up to 0.1 percent zirconium;
the balance being nickel and incidental impurities;

wherein the overall concentration in the alloy of aluminium, titanium, tantalum, and niobium is from 13 to 14 atomic percent and the atomic ratio of aluminium to titanium is from 4.625:1 to 6.333:1.

The alloy may be used in various applications, such as in a gas turbine engine. The alloy may be provided in powder form. The powder may be used in a method of producing a nickel-base superalloy article, comprising:

consolidating the powder to produce an intermediate;

forging the intermediate under isothermal conditions to produce a forging;

solution heat treating the forging above the gamma prime solvus temperature of the nickel-base superalloy;

quenching the forging;

performing a plurality of post-solution heat treatments on the forging.

DETAILED DESCRIPTION

The alloy of the present invention has a nickel base. In solid form, the crystallographic matrix of the alloy comprises both a gamma (y) phase and a gamma prime (V) phase, the latter of which is largely responsible for the strength of the alloy at high temperatures, such as those encountered in the high pressure systems of gas turbine engines.

Thus, in order to maximise the high-temperature strength of the alloy, the quantity of gamma prime is high, and in a specific embodiment is from 52 to 56 percent. In the present embodiment, these levels of gamma prime are achieved by providing aluminium, titanium, tantalum, and niobium at an overall concentration which observes the following relation in terms of atomic percent:

$$13 \leq Al+Ti+Ta+Nb \leq 14 \quad \text{[Equation 1]}$$

In a specific embodiment, the overall concentration in the alloy of aluminium, titanium, tantalum, and niobium may be greater than or equal to 13.5 atomic percent, which achieves around 54 percent gamma prime precipitates.

Processability of the alloy as compared with prior art nickel-base superalloys is improved by provision of a high quantity of cobalt to reduce its gamma prime solvus temperature. In particular, the alloys according to the present invention have an overall concentration of cobalt according to the following relation in terms of atomic percent:

$$15 \leq Co \leq 26.5 \quad \text{[Equation 2]}$$

In conjunction with this, the atomic ratio of the aluminium to titanium constituents is controlled according to the following relation:

$$4.625 \leq Al:Ti \leq 6.333 \quad \text{[Equation 3]}$$

In combination, this concentration of cobalt and relationship between the quantity of aluminium and titanium enables a reduction in gamma prime solvus temperature to 1140 degrees Celsius or below. By way of comparison, a prior nickel-base superalloy designated RR1000, which forms the subject-matter of European Patent No 2 894 234, which patent is assigned to the present applicant, have gamma prime solvus temperatures of above 1140 degrees Celsius, typically between 1150 and 1180 degrees Celsius.

Prior nickel-base superalloys with reduced levels of boron typically have incipient melting temperatures of between 1200 and 1225 degrees Celsius. In contrast, the alloys according to the present invention have an incipient melting temperature of 1170 degrees Celsius or higher, typically between 1190 and 1215 degrees Celsius.

A further advantage of a low gamma prime solvus temperature is the effect on the size of secondary gamma prime precipitates which form on quenching the alloy after solution heat treatment. As the nucleation and growth of these precipitates is governed by diffusion, small secondary gamma prime precipitates can be produced if the solution heat treatment temperature is low, i.e. at or below 1160 degrees Celsius. This is advantageous as the effectiveness of these precipitates in preventing the movement of dislocations is inversely proportional to their size—hence small particles promote high values of yield stress.

The inventors have observed that the potency of gamma prime particles in nickel-base superalloys to impede the movement of dislocations is determined by their composition, their volume fraction and their size. Composition determines the energies of anti-phase boundaries and stacking faults, which form when pairs of partial dislocations enter gamma prime particles.

Improvements in yield stress have been found by not relying solely on a gamma prime ($Ni_3Al$) phase, but instead by replacing some of the aluminium constituent in the gamma prime phase by a combination of titanium, tantalum and niobium. Thus, whilst still observing the overall constituent relation specified in Equation 1, and the ratio specified in Equation 3, the concentration of these constituents may, in one or more embodiments, observe one or more of the following relations, in terms of atomic percent:

$$9.25 \leq Al \leq 9.5 \quad \text{[Equation 4]}$$

$$1.5 \leq Ti \leq 2 \quad \text{[Equation 5]}$$

$$1.25 \leq Ta \leq 2 \quad \text{[Equation 6]}$$

$$0.9 \leq Nb \leq 1.5 \quad \text{[Equation 7]}$$

In addition to its role in reducing the gamma prime solvus temperature of the alloys of the present invention, cobalt is also observed to improve several other material properties, notably resistance to creep strain accumulation and the development of cracks from low cycle fatigue. Further, cobalt is beneficial in lowering stacking fault energy of the gamma phase and in promoting annealing twins. This first aspect of lowering stacking fault energy is advantageous, particularly for solid solution strengthening, since the ability of dislocations to climb over gamma prime particles is made more difficult if the length of the stacking fault between partial dislocations increases as a result of a lower stacking fault energy. This produces an improvement in creep resistance of the alloy. The number of annealing twins may increase with lower stacking fault energy, which is beneficial as these are high angle boundaries that reduce the effective length of slip bands that give rise to low cycle fatigue crack nucleation at temperatures below 650 degrees Celsius. Since slip bands are the dominant damage mechanism for fatigue crack nucleation at these temperatures for coarse grain microstructures, increasing the number of annealing twins will improve fatigue performance.

As described previously, it is beneficial to minimise the gamma prime solvus temperature and maximise the temperature difference between this and the solidus temperature of the alloy. Increasing cobalt content reduces the gamma prime solvus temperature, particularly if titanium levels are also carefully selected, as in this invention.

A further benefit of cobalt is its ability to influence the size and shape of secondary or quenching gamma prime precipitates, particularly those in intergranular locations. For a given cooling rate from super-solvus solution heat treatment, increasing cobalt content reduces the size of secondary gamma prime precipitates. Increasing cobalt content may also retard the deviation from a spherical morphology at slower cooling rates.

It should be noted, however, that the concentration of cobalt is limited as too high a level may produce non-optimised resistance to hot corrosion and time dependent crack growth, along with increasing the cost of the alloy.

The contribution of niobium and tantalum to gamma prime is advantageous as these elements show slower rates of diffusion in nickel compared to aluminium and titanium, which is significant during quenching of forgings and high temperature operation in terms of reducing the rate of coarsening of secondary and tertiary gamma prime respectively, and in terms of resistance to oxidation damage since aluminium and titanium readily migrate from gamma prime to form oxidation products.

Unlike titanium and niobium, tantalum may not be detrimental to oxidation resistance and has been shown to improve time dependent crack growth resistance. Niobium is detrimental to dwell crack growth as a result of the oxidation of large blocky MC carbides and delta (δ) phase ($Ni_3Nb$), which resides on grain boundaries and form brittle niobium pentoxide ($Nb_2O_5$). However, the effect of niobium on dwell crack growth behaviour is less important than its beneficial microstructural effects such as grain size and size of gamma prime particles. In order to facilitate powder metallurgy processing of the alloys according to the present invention, niobium levels of up to 1.5 atomic percent may be utilised.

In an example, the alloys of the present invention may be produced in powder form by a powder metallurgy process. The powder may have particles of less than 53 micrometres in size. The powder size may be controlled using a screen having a selected aperture size, such as 53 micrometres (a 270 mesh screen).

Optimal environmental resistance, in particular to hot corrosion and oxidation, may be achieved by the provision of chromium, which forms a protective chromia scale ($Cr_2O_3$) at the surface of the alloy. However, this is not a barrier to oxygen diffusion. As such, a layer of alumina ($Al_2O_3$) forms below the chromia scale, which minimises further diffusion of oxygen into the alloy matrix.

The ratio of aluminium-to-titanium specified in Equation 3 complements this environmental resistance strategy by providing sufficient aluminium to form a continuous alumina layer, whilst minimising the detrimental effect of titanium on the chromia scale. The resistance of the alloy to oxidation damage can be correlated, at least to a first approximation, to atomic ratio of chromium to titanium in the alloy. In particular, the higher this ratio, the better the oxidation resistance. However, the desire to increase the concentration of chromium must be tempered as high concentrations, for example over 20 percent by weight, cannot be added to alloys which precipitate high levels of gamma prime, as in the case of alloys according to the present invention. This is because detrimental topologically close packed (TCP) phases, such as sigma (σ, $(Ni, Co,Fe)_x(Cr,$ $Mo,W)_y$, $1 \leq x,y \leq 7$) or mu (μ, $(Ni,Co,Fe)_7(Cr,Mo,W)_6$) can form during high temperature exposure.

Thus, in an embodiment, up to 14.0 weight percent chromium is included. In a specific embodiment, chromium is provided at a concentration according to the following relation in weight percent:

$$10.0 \leq Cr \leq 14.0 \quad \text{[Equation 8]}$$

The upper bound on the chromium concentration may in some specific embodiments be limited to 12.0 weight percent to further mitigate detrimental phenomena, such as the formation of TCP phases. In specific embodiments, the minimum chromium concentration is 10.5 weight percent to ensure sufficient environmental resistance.

In a specific embodiment, the atomic ratio of chromium-to-titanium is maximised, whilst observing the maximum concentration allowed by the relation of Equation 8.

Further contributions to the strength of the alloy from the gamma matrix may be achieved in an embodiment by adding one or more of molybdenum and tungsten. In a specific embodiment, both molybdenum and tungsten are added, with the overall concentration of these constituents observing the following relations, in terms of atomic percent:

$$2.5 \leq Mo+W \leq 3.25 \quad \text{[Equation 9]}$$

Molybdenum and tungsten partition to, and strengthen the gamma phase by substitutional solid solution strengthening. As they are larger atoms than nickel atoms that they replace, they are potent solid solution strengthening elements. In a specific embodiment, the minimum combined concentration of the molybdenum and tungsten constituents is 2.75 atomic percent.

Molybdenum is particularly effective as a higher proportion of the quantity added partitions to the gamma phase, unlike tungsten, which partitions in higher concentrations to gamma prime. Tungsten also has a more detrimental effect on alloy density. However, in a specific embodiment the molybdenum content is limited, as it promotes the formation of TCP phases. The concentration of molybdenum may therefore be specified at a level which provides optimised gamma strength and lattice parameter size without producing detectable levels of TCP phases in service.

In addition to the correlation for oxidation resistance above, resistance to Type II hot corrosion damage can be correlated, to a first approximation, to the atomic ratio of chromium to the combined amount of molybdenum and tungsten, as molybdenum and tungsten both produce detrimental acidic oxides. Thus, in a specific embodiment, the alloy comprises chromium, tungsten and molybdenum, with the atomic ratio of chromium to combined amount of molybdenum and tungsten maximised, within the constraints of Equation 8.

In an embodiment, a concentration of molybdenum up to 4.2 weight percent is included. In a specific embodiment, the concentration of molybdenum is from 1.9 to 4.2 weight percent. In another specific embodiment, the concentration of molybdenum is from 2.3 to 4.2 weight percent. More specifically, the concentration of molybdenum may be from 2.8 to 3.8 weight percent. Alternatively, the concentration of molybdenum may be from 2.4 to 3.4 weight percent.

In an embodiment, a concentration of tungsten up to 4.9 weight percent is included. In a specific embodiment, the concentration of tungsten is from 1.5 to 4.9 weight percent. More specifically, the concentration of tungsten may be from 3.0 to 4.9 weight percent. In another embodiment, the concentration of tungsten up to 4.0 weight percent is included. In a specific embodiment, the concentration of tungsten may be from 2.2 to 4.0 weight percent.

An advantage of the low gamma prime solvus temperature conferred by the cobalt concentration and the ratio of aluminium to titanium, is that it enables higher levels of boron to be added to the alloy. Boron is beneficial as it (through elemental boron or stable $M_5B_3$ boride particles) improves strength, ductility, and toughness at grain boundaries, which are sources of weakness and fracture during time-dependent crack growth. However, substantial additions of boron are not typically favoured because it lowers the incipient melting temperature of the alloy, thereby reducing the heat treatment window.

Nevertheless, such reductions in incipient melting temperature can be tolerated in alloys of the present invention due to the depressed gamma prime solvus temperature. Thus, in an embodiment, the alloy may comprise boron at a concentration of up to 0.07 weight percent. By comparison, prior art nickel-base superalloys such as RR1000 typically have boron levels controlled to levels below 0.025 percent by weight. In practice, the boron concentration may be from 0.01 to 0.07 percent by weight. More specifically, it may be from 0.02 to 0.045 percent by weight.

In an embodiment, the alloy further comprises manganese for sulphur scavenging. In the presence of sulphur, manganese forms high melting point sulphides. This reduces the available sulphur in the alloy that can form low melting point nickel sulphide films ($Ni_3S_2$) on grain boundaries. Such films can cause high temperature grain boundary embrittlement of nickel-base superalloys, in particular those that contain sulphur. Thus, in an embodiment, the addition of manganese is accompanied by the addition of chromium discussed above.

Further, manganese can reduce the rate of ingress of sulphur or sulphur trioxide ($SO_3$) during the development of fatigue cracks at temperatures of 600 to 750 degrees Celsius in air-sulphur dioxide ($SO_2$) environments as a result of low melting point sodium sulphate ($Na_2SO_4$) based compounds that are deposited on, for example, gas turbine disc rotors in service. In an embodiment, the manganese concentration is up to 1.0 weight percent to provide a good level of sulphur scavenging. In a specific embodiment, the manganese is provided at a concentration of from 0.2 to 0.6 weight percent.

In an embodiment, the alloy further comprises zirconium both time dependent crack growth resistance, and sulphur and oxygen scavenging.

It is desirable to add the highest levels of zirconium without introducing detrimental effects as it can optimise the resistance to time dependent crack growth. For both cast and forged polycrystalline superalloys that are used in gas turbine applications, zirconium provides improved high temperature tensile ductility and strength, creep life and rupture strength. Furthermore, zirconium has an affinity for oxygen and sulphur and scavenges these elements, thereby limiting the potential of oxides and sulphur or sulphides to reduce grain boundary cohesion. It also contributes to stable primary MC carbides. Excessive quantities of zirconium, however, can produce small oxide particles during melting, which can agglomerate and be sources of fatigue crack nucleation. Thus, in an embodiment, zirconium is included in the alloy at a concentration of up to 0.1 weight percent, which achieves a good balance of both time dependent crack growth resistance, and sulphur and oxygen scavenging, without excessive formation of zirconium oxides. In a specific embodiment, the zirconium concentration may be from 0.035 to 0.1 weight percent. More specifically, the concentration of zirconium may be from 0.05 to 0.1 weight percent.

In an embodiment, the alloy further comprises carbon to form carbides with one or more of the titanium, tantalum, and niobium constituents. In an embodiment, the carbon is provided at a concentration of up to 0.06 weight percent. In a specific embodiment, the carbon concentration may be from 0.02 to 0.06 weight percent. More specifically, the carbon concentration may be from 0.02 to 0.04 weight percent. In order to minimise the formation of $M_{23}C_6$ carbides during high temperature exposure, which may cause internal oxidation damage, the concentration of carbon may be limited to 0.03 weight percent.

Alternatively, the concentration of carbon may instead be from 0.05 to 0.06 weight percent in order to control grain growth through grain boundary pinning during super-solvus solution heat treatment. The higher concentration of carbon may produce a smaller average grain size and a narrow grain size distribution, with lower values for isolated grains that occupy the upper end of the grain size distribution. This is significant as yield stress and fatigue endurance at intermediate temperatures (less than 650 degrees Celsius) are highly sensitive to grain size. Carbon levels of 0.05 to 0.06 weight percent may also improve ductility and toughness at hot working temperatures.

In an embodiment, the alloy further comprises iron at a concentration of up to 1.0 weight percent. This enables machining chips and solid scrap from powder billet to be included in alloy manufacture. Such levels of iron can be tolerated in terms of the stability of the alloy, and may reduce material costs. In a specific embodiment, the iron concentration may be from 0.4 to 1.0 weight percent. More specifically, the iron concentration may be from 0.8 to 1.0 weight percent.

In an embodiment, the alloy further comprises silicon at an effective concentration for oxidation resistance. Silicon promotes the formation of the continuous layer of alumina discussed above. The amount of silicon added is limited, however, as it may promote the formation of TCP phases, notably sigma. Thus, the silicon is provided at a concentration of up to 0.5 weight percent. In a specific embodiment, the silicon is provided at a concentration of 0.25 weight percent.

In terms of impurities, the alloy is tolerant to the presence of sulphur at less than 20 parts per million, and preferably less than 5 parts per million. In addition, or alternatively, the alloy is tolerant to the presence of phosphorus at less than 60 parts per million, and preferably less than 40 parts per million.

The alloys according to the present invention may have density values of between 8.35 grams per cubic centimetre, and 8.5 grams per cubic centimetre. This is in comparison to prior alloys which have densities exceeding 8.5 grams per cubic centimetre.

In summary, therefore, nickel-base alloys according to the present invention may adopt the constituents set out in Table 1 below:

TABLE 1

| Constituent | Limits (wt. %) | Range (wt. %) | Aim (wt. %) |
|---|---|---|---|
| Co | 14.75-26.5 | 14.75-26.5 | 15.0-24.0 |
| Al | 4.1-4.65 | 4.1-4.65 | 4.1-4.65 |
| Ti | 1.1-1.9 | 1.1-1.9 | 1.1-1.9 |
| Ta | 3.85-6.3 | 3.85-6.3 | 4.0-5.5 |

TABLE 1-continued

| Constituent | Limits (wt. %) | Range (wt. %) | Aim (wt. %) |
|---|---|---|---|
| Nb | 1.2-2.55 | 1.2-2.55 | 1.2-2.2 |
| B | ≤0.07 | 0.01-0.07 | 0.2-0.045 |
| C | ≤0.06 | 0.02-0.06 | 0.02-0.04 |
| Cr | ≤14.0 | 10.0-14.0 | 10.0-12.0 |
| Fe | ≤1.0 | 0-1.0 | 0.4-1.0 |
| Mn | ≤1.0 | 0-1.0 | 0.2-0.6 |
| Mo | ≤4.2 | 1.9-4.2 | 2.4-3.4 |
| Si | ≤0.5 | 0-0.5 | 0.15-0.35 |
| W | ≤4.9 | 1.5-4.9 | 3.0-4.9 |
| Zr | ≤0.1 | 0.035-0.1 | 0.05-0.1 |
| Ni | Bal. | Bal. | Bal. |
| P | <60 ppm | <60 ppm | <40 ppm |
| S | <20 ppm | <20 ppm | <5 ppm |

Three example alloys have been prepared adopting the weight percentages set out in Table 2 below:

TABLE 2

| Constituent | Alloy 1 | Alloy 2 | Alloy 3 |
|---|---|---|---|
| Co | 19 | 19 | 19 |
| Al | 4.25 | 4.25 | 4.25 |
| Ti | 1.6 | 1.6 | 1.6 |
| Ta | 3.85 | 4.6 | 3.85 |
| Nb | 1.6 | 1.6 | 1.6 |
| B | 0.04 | 0.04 | 0.04 |
| C | 0.03 | 0.03 | 0.03 |
| Cr | 11.5 | 11.5 | 11.5 |
| Fe | 0.9 | 0.9 | 0.9 |
| Mn | 0.55 | 0.55 | 0.55 |
| Mo | 3.25 | 3.25 | 3.25 |
| Si | 0 | 0 | 0.25 |
| W | 3.9 | 3.9 | 3.9 |
| Zr | 0.09 | 0.09 | 0.09 |
| Ni | Bal. | Bal. | Bal. |

The above-described superalloys may be produced using powder metallurgy technology, such that small powder particles (less than 53 micrometres in size) from inert gas atomisation are consolidated in a stainless steel container using hot isostatic pressing or hot compaction and then extruded or hot worked to produce fine grain size billet intermediate (grain size of less than 5 micrometres in size). Increments may be cut from these billets and forged under isothermal conditions. Appropriate forging temperatures, strains and strain rates and heating rates during solution heat treatment may be used to achieve an average grain size of ASTM 8 to 6 (22 to 45 micrometres) following solution heat treatment above the gamma prime solvus temperature.

To generate the required balance of properties in the above described superalloys, a heat treatment process may be performed, as described heretofore.

First, the forging is solution heat treated above the gamma prime solvus temperature of the alloy. This grows the grain size to the required average grain size of ASTM 8 to 6 (22 to 45 micrometres) throughout. Appropriate forging conditions, levels of deformation and heating rates in solution heat treatment are used to achieve the required average grain size and prevent isolated grains from growing to sizes greater than ASTM 2 (180 micrometres).

Next, the forging is quenched from the solution heat treatment temperature to room temperature using forced or fan air cooling. The resistance to dwell crack growth is optimised if the cooling rate from solution heat treatment is defined so as to produce grain boundary serrations around secondary gamma prime particles.

Next, a first, high temperature ageing heat treatment of 1 to 4 hours at temperatures between about 820 degrees Celsius and 860 degrees Celsius is carried out, followed by a second, lower temperature ageing heat treatment of 1 to 8 hours at temperatures between about 760 degrees Celsius and 810 degrees Celsius then air cool. These post-solution heat treatments precipitate the necessary distribution (in terms of size and location) of tertiary gamma prime particles to optimise the resistance to time dependent crack growth whilst producing adequate yield stress and resistance to creep strain accumulation from high stresses at temperatures below 750 degrees Celsius.

If higher levels of yield stress and low cycle fatigue performance are required in the bore and diaphragm regions of the disc rotor at temperatures below 650 degrees Celsius, then a dual microstructure solution heat treatment may be applied to forgings to produce a fine (5 to 10 micrometres) average grain size in these regions.

The above described superalloys may provide several advantages. For example, they may have, relative to existing alloys:

improved dwell crack growth resistance at temperatures of 600 to 775 degrees Celsius;

improved resistance to oxidation and hot corrosion damage at temperatures of 600 to 800 degrees Celsius;

improved tensile proof strength at temperatures of 20 to 800 degrees Celsius;

improved resistance to creep strain accumulation at temperatures of 650 to 800 degrees Celsius;

improved dwell fatigue endurance behaviour at temperatures above 600 degrees Celsius; and/or improved fatigue endurance behaviour at temperatures below 650 degrees Celsius.

The alloys described herein may be particularly suitable to produce forgings for disc rotor applications, in which resistance to time dependent crack growth is optimised. Components manufactured from these alloys may have a balance of material properties that will allow them to be used at significantly higher temperatures. In contrast to known alloys, such as RR1000, the alloys described herein achieve a better balance between resistance to time dependent crack growth, environmental degradation, and high temperature mechanical properties such as proof strength, resistance to creep strain accumulation and dwell fatigue, while maintaining a stable microstructure. This has been achieved without unacceptable compromises to density and cost.

In testing, alloys according to the invention have shown improvements over prior alloys, in particular in terms of tensile and creep properties.

To perform testing, samples of Alloy 1 and Alloy 2 were prepared. They were argon gas atomised, and then screened to −270 mesh (53 micrometres). The powders were each filled into a respective 76.2 millimetre diameter mild steel container and hot isostatically pressed. The resulting bars were machined to about 76 millimetres high and about 65 to 70 millimetres in diameter. The bars were then isothermally forged down to about 18 millimetres high, and about 140 millimetres in diameter. Blanks were extracted from mid-height locations and heat treated.

The gamma prime solvus temperatures of Alloy 1 and Alloy 2 were found to be below 1140 degrees Celsius. The blanks were solution heat treated above the gamma prime solvus temperature, at 1150 degrees Celsius for 1 hour, and cooled at a rate of 1.2 degrees Celsius per second. A post-solution heat treatment was performed at 843 degrees Celsius for 2 hours, and then at 800 degrees Celsius for 2 hours. The resulting grain size for both Alloy 1 and Alloy 2 was found to be about 20-25 micrometres.

Substantially the same procedure was used to produce samples of RR1000. The RR1000 blanks were solution heat treated above the alloy's gamma prime solvus temperature, at 1170 degrees Celsius for 1 hour, and cooled at a rate of 1.0 degrees Celsius per second. The blanks were then post-solution heat treated at 760 degrees Celsius for 16 hours. The grain size was found to be 17±8 micrometres.

A comparison of the proof stress and tensile strength of the alloys is shown in Table 3 below:

TABLE 3

| | 0.2% proof stress (MPa) | | | Tensile strength (MPa) | | |
|---|---|---|---|---|---|---|
| T (° C.) | RR1000 | Alloy 1 | Alloy 2 | RR1000 | Alloy 1 | Alloy 2 |
| 20 | 1055 | 1129 | 1136 | 1527 | 1586 | 1596 |
| 600 | 966 | 1048 | 1052 | 1436 | 1494 | 1506 |
| 700 | 962 | 1010 | 1034 | 1355 | 1379 | 1399 |
| 800 | 900 | 965 | 980 | 1092 | 1162 | 1167 |

A comparison of the creep strain and rupture characteristics of the alloys is shown in Table 4 below:

TABLE 4

| | Time to 0.2% creep strain (hours) | | | Time to rupture (hours) | | |
|---|---|---|---|---|---|---|
| T, P | RR1000 | Alloy 1 | Alloy 2 | RR1000 | Alloy 1 | Alloy 2 |
| 650° C., 1000 MPa | 0.3 | 4 | 5 | 62 | 143 | 177 |
| 700° C., 800 MPa | 23 | 11 | 9 | 72 | 177 | 121 |

It will be understood that except where mutually exclusive, any of the features of the invention may be employed separately or in combination with any other features and the disclosure extends to and includes all combinations and sub-combinations of one or more features described herein.

The invention claimed is:

1. A nickel-base superalloy consisting essentially of, by weight:

14.75 to 26.5 percent cobalt;
4.1 to 4.65 percent aluminium;
1.1 to 1.9 percent titanium;
3.85 to 6.3 percent tantalum;
1.2 to 2.55 percent niobium;
up to 0.07 percent boron;
up to 0.06 percent carbon;
up to 14.0 percent chromium;
up to 1.0 percent iron;
0.2 to 1.0 percent manganese;
up to 4.2 percent molybdenum;
0.15 to 0.5 percent silicon;
up to 4.9 percent tungsten;
up to 0.1 percent zirconium;
the balance being nickel and incidental impurities;
wherein the overall concentration in the alloy of aluminium, titanium, tantalum, and niobium is from 13 to 14 atomic percent and the atomic ratio of aluminium to titanium is from 4.625:1 to 6.333:1.

2. The nickel-base superalloy of claim 1, including, by weight, one or more of the following:

0.01 to 0.07 percent boron;
0.02 to 0.06 percent carbon;
10.0 to 14.0 percent chromium;
0.4 to 1.0 percent iron;

1.9 to 4.2 percent molybdenum;
1.5 to 4.9 percent tungsten;
0.035 to 0.1 percent zirconium.

3. The nickel-base superalloy of claim 1, including, by weight, one or more of the following:
15.0 to 24.0 percent cobalt;
4 to 5.5 percent tantalum;
1.2 to 2.2 percent niobium;
0.02 to 0.045 percent boron;
0.02 to 0.04 percent carbon;
10.0 to 12.5 percent chromium;
0.2 to 0.6 percent manganese;
2.4 to 3.4 percent molybdenum;
0.15 to 0.35 percent silicon
3.0 to 4.9 percent tungsten;
0.05 to 0.1 percent zirconium.

4. The nickel-base superalloy of claim 1, consisting essentially of, by weight:
14.75 to 26.5 percent cobalt;
4.1 to 4.65 percent aluminium;
1.1 to 1.9 percent titanium;
3.85 to 6.3 percent tantalum;
1.2 to 2.55 percent niobium;
0.01 to 0.07 percent boron;
0.02 to 0.06 percent carbon;
10.0 to 14.0 percent chromium;
up to 1.0 percent iron;
0.2 to 1.0 percent manganese;
1.9 to 4.2 percent molybdenum;
0.15 to 0.5 percent silicon;
1.5 to 4.9 percent tungsten;
0.035 to 0.1 percent zirconium;
the balance being nickel and incidental impurities.

5. The nickel-base superalloy of claim 4, containing less than 60 ppm phosphorus and less than 20 ppm sulphur.

6. The nickel-base superalloy of claim 1, consisting essentially of, by weight:
15.0 to 24.0 percent cobalt;
4.1 to 4.65 percent aluminium;
1.1 to 1.9 percent titanium;
4.0 to 5.5 percent tantalum;
1.2 to 2.2 percent niobium;
0.02 to 0.045 percent boron;
0.02 to 0.04 percent carbon;
10.0 to 12.0 percent chromium;
0.4 to 1.0 percent iron;
0.2 to 0.6 percent manganese;
2.4 to 3.4 percent molybdenum;
0.15 to 0.35 percent silicon;
3.0 to 4.9 percent tungsten;
0.05 to 0.1 percent zirconium;
the balance being nickel and incidental impurities.

7. The nickel-base superalloy of claim 6, containing less than 40 ppm phosphorus and less than 5 ppm sulphur.

8. The nickel-base superalloy of claim 1, containing less than 60 ppm phosphorus and less than 20 ppm sulphur.

9. Powder form of the nickel-base superalloy of claim 1.

10. Powder form of the nickel-base superalloy of claim 2.

11. Powder form of the nickel-base superalloy of claim 3.

12. A method of producing a nickel-base superalloy article, comprising:
consolidating a powder according to claim 9 to produce an intermediate;
forging the intermediate under isothermal conditions to produce a forging;
solution heat treating the forging above the gamma prime solvus temperature of the nickel-base superalloy;
quenching the forging;
performing a plurality of post-solution heat treatments on the forging.

13. The method of claim 12, in which the post-solution heat treatments comprise:
a first aging treatment at a first temperature for a first period of time;
a second aging treatment at a second temperature less than the first temperature for a second period of time.

14. The method of claim 13, in which the second period of time is longer than the first period of time.

15. The method of claim 13 in which the first temperature is from 820 to 860 degrees Celsius and the first period of time is from 1 to 4 hours.

16. The method of claim 13, in which the second temperature is from 760 to 810 degrees Celsius and the second period of time is from 1 to 8 hours.

* * * * *